US006505388B1

(12) United States Patent
Becan et al.

(10) Patent No.: US 6,505,388 B1
(45) Date of Patent: Jan. 14, 2003

(54) APPARATUS AND METHODS FOR CARVING AND SEPARATING CARPET

(75) Inventors: Andrew M. Becan, Slatington, PA (US); Jeffrey L. Fink, Birdsboro, PA (US); Gregory A. Rawley, Wynnewood, PA (US)

(73) Assignee: Eagle Automation, Inc., Exton, PA (US)

( * ) Notice: Subject to any disclaimer, the term of this patent is extended or adjusted under 35 U.S.C. 154(b) by 0 days.

(21) Appl. No.: 10/146,240

(22) Filed: May 15, 2002

Related U.S. Application Data

(62) Division of application No. 09/483,750, filed on Jan. 17, 2000, now Pat. No. 6,430,787.

(51) Int. Cl.[7] ..... D06C 23/02; B26D 1/00

(52) U.S. Cl. ..... 26/16; 26/7; 83/27

(58) Field of Search ..... 26/7, 8 R, 9, 10 R, 26/10 C, 8 C, 11, 12, 13, 16, 15 R, 2 R; 28/170, 163, 160; 83/102, 433, 62, 62.1, 63, 72, 936, 937, 938, 939, 940, 27, 23, 13, 14, 39, 49

(56) References Cited

U.S. PATENT DOCUMENTS

| | | | | |
|---|---|---|---|---|
| 1,557,345 A | | 10/1925 | Schumacher | |
| 2,935,778 A | | 5/1960 | Bryant et al. | 26/16 |
| 3,657,952 A | | 4/1972 | Brockbank et al. | 83/102 |
| 4,186,632 A | | 2/1980 | Leslie et al. | 83/13 |
| 4,218,810 A | | 8/1980 | Engels | 26/16 |
| 4,419,913 A | * | 12/1983 | Schutt et al. | 83/27 |
| 4,581,965 A | | 4/1986 | Gerber | 83/24 |
| 4,653,362 A | | 3/1987 | Gerber | 83/16 |
| 4,793,033 A | | 12/1988 | Schneider et al. | 26/16 |
| 5,285,558 A | | 2/1994 | Carder et al. | 26/7 |
| 5,388,488 A | | 2/1995 | Geidl et al. | 83/56 |
| 5,450,333 A | | 9/1995 | Minami et al. | 364/474.09 |
| 5,979,278 A | | 11/1999 | Warthen et al. | 83/20 |
| 6,164,178 A | | 12/2000 | Lattoni et al. | 83/941 |
| 6,360,639 B1 | * | 3/2002 | Gerber | 83/940 |

* cited by examiner

*Primary Examiner*—A. Vanatta
(74) *Attorney, Agent, or Firm*—Woodcock Washburn LLP

(57) ABSTRACT

A design is formed in a carpet secured to a table with a carriage controlled and moved over the table by a computer. A carver is mounted to the carriage and is computer-controlled to carve a design into the secured carpet. Also, a separator is mounted to the carriage and is computer-controlled to separate the carved carpet into a plurality of pieces. The secured carpet has a grain extending in a first particular direction, and carving in a second particular direction produces an actual result offset from an intended result by a quantified offset. The first direction and second directions are determined and a relationship therebetween is calculated. An offset associated with such relationship is then determined, and the determined offset is employed to position a carver during carving in the second direction. Thus, the employed offset produces an actual result that aligns with the intended result. A carpet tool during operation emits vibrations at a plurality of frequencies and during normal operation emits vibrations at a particular dominant frequency. The emitted vibrations are sensed, and it is determined whether the sensed vibrations are within a normal range about the particular dominant frequency. If not, a mechanical malfunction is presumed and carpet tool operation stops. In a variation, an obstructing malfunction such as a carver snagging on carpet is alleviated by use of a spring hinge mount for such carver.

4 Claims, 9 Drawing Sheets

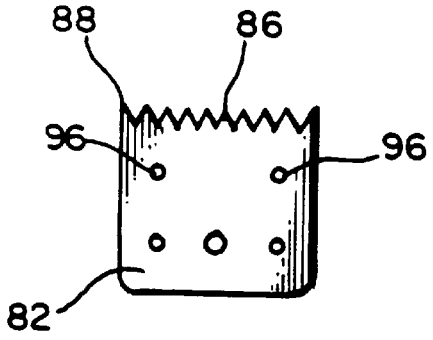
FIG. 7
FIG. 8
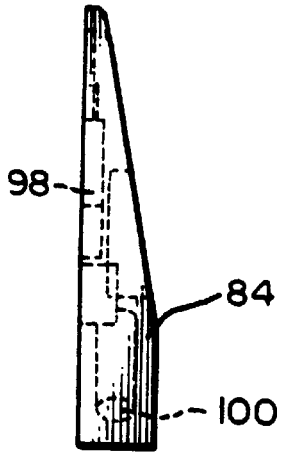
FIG. 9
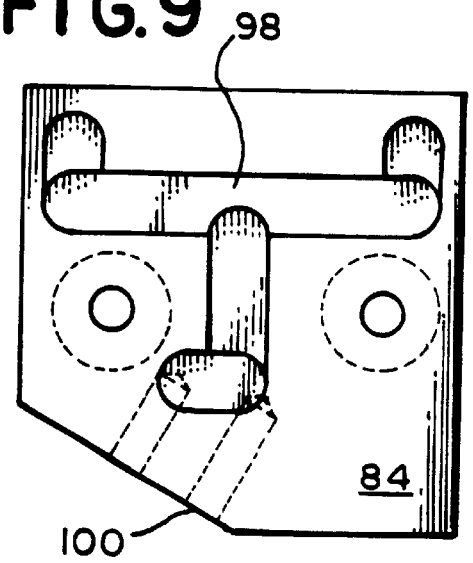
FIG. 10
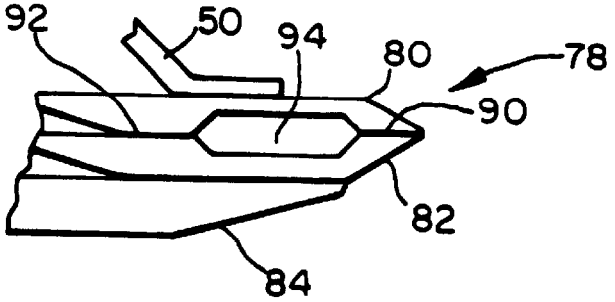

APPARATUS AND METHODS FOR CARVING AND SEPARATING CARPET

CROSS-REFERENCE TO RELATED APPLICATIONS

This application is related to U.S. patent application Ser. No. 09/237,526, filed Jan. 27, 1999 and entitled "APPARATUS AND METHODS FOR SCULPTING CARPET", hereby incorporated by reference.

This application is a divisional of Ser. No. 09/483,750, filed Jan. 17, 2000, now U.S. Pat No 6,430,787, the entirety of which is incorporated herein by reference.

FIELD OF THE INVENTION

The present invention relates to the field of carpet manufacture, and more particularly to methods and apparatus for carving patterns in carpet pile.

BACKGROUND OF THE INVENTION

As is known, carpet typically includes a backing or base and a pile that is mounted to such base by any of a variety of known processes. As has been recognized in the past, designers and artisans have employed various design treatments with respect to carpeting used on both floors and walls. In particular, decorative designs have been carved in the carpet pile using hand-held electric or air powered carpet shears or clippers.

In the past, to carve decorative designs in carpet pile, it had been suggested to use templates, to pre-mark the carpet and manually carve a pattern in the pile and to use automated, computer controlled carving tables. Since carved effects can involve complex, intricate decorative designs, computer controlled equipment is preferred, not only for purposes of reliability and repeatability, but also to reduce the cost of having a highly skilled artisan engage in such a time consuming task.

One such computer controlled device, disclosed in U.S. Pat. No. 4,793,033—Schneider, et al. and incorporated herein by reference, includes a carriage mechanism adapted to move a clipping mechanism in two dimensions, i.e., to move the clipping mechanism in X and Y directions. This movement is said to be controlled by a computer having a memory into which desired patterns have been stored. In particular, the carriage mechanism includes a table on which a first pulley system moves a wheeled gantry-like structure in one direction and on which a second pulley system located on the gantry moves a wheeled platform in a second perpendicular direction. The clipping mechanism is said to be attached to the platform via a manually adjustable tripod mount which is said to permit variation of the angular orientation of the clipping mechanism. It is asserted that other disclosed mechanisms can move the clipping mechanism vertically as well as rotationally.

Unfortunately, such a computer controlled device suffers from several problems. First, because the clipping mechanism is moved via a tripod mount, setting or making changes to the angular orientation of the clipping blades will result in a relocation of the leading edge or leading prongs, i.e., the beginning carving point will be offset from the pivot point in the mount. Since the angular setting or adjustment is manually achieved, it will be necessary, if even possible, to align/calibrate or re-align/calibrate the computer program and the clipper blades after each manual adjustment to allow for the relocation of the leading edge, so that the clipping blades carve in the exact locations specified by the computer.

Second, because the device is automated, the clipping blades will be moving relative to one another for extended periods of time. The friction forces generated during the clipping operation will lead to elevated temperatures of the clipping blades. It has been found that such elevated temperatures cause the clipping blades to become dull faster, requiring replacement, thereby adding to the cost of operations. Although Schneider et al. suggests providing a lubricant drip to the blades and a vacuum operation, these features are not believed sufficient to maintain acceptable blade temperature for extended periods.

In addition, the Schneider et al. device does not account for pile deflection. It has been found that when a clipping mechanism is brought into contact with the carpet pile, the bottom of the clipping mechanism tends to compress or deflect the pile directly under the clipping blades. This deflection or compression can cause unwanted imperfections, i.e., extraneous tufts. Moreover, for direction changes where a clipping blade would be moved away from and then onto the pile, the tuft imperfection itself can be deflected or compressed, making matters worse. The presence of such tuft imperfections will require a manual finishing operation in order to achieve the desired appearance, or alternatively the design must be re-run, possibly several times. Moreover, carpet pile over an extended area can have a random angle, bias or direction. During manual carving operations, the artisan will frequently brush the pile with a hand in order to orient the pile in a desired direction before clipping. The Schneider et al. device makes no mention, nor does it suggest a solution to this problem.

Although not resolving any of the above described problems, U.S. Pat. No. 5,285,558—Carder et al., incorporated herein by reference, discloses a hand operated device, containing a clipping mechanism, which is moved manually to trim carpet pile or to bevel the edge of the pile. In relation to the beveling operation, Carder et al. disclose a mounting bracket which permits pivoting of the clipping mechanism. Unfortunately, this pivoting movement also results in a relocation of the leading edge or leading prongs.

Consequently, a need still exists for a carpet clipping device which controls clipping blade temperature during extended clipping operation, provides accurate angled orientation of the clipping blades, accounts for pile compression/deflection whenever the clipping blade is moved against the pile and which accounts for random pile direction.

In addition to carving carpet, designers and artisans have formed decorative designs by carefully separating and recombining multiple pieces of carpet into a new composite or fabricated carpet. Typically, the multiple pieces include several colors and/or textures, and the composite or fabricated carpet therefore includes the several colors and/or textures which in combination connote the decorative design.

When forming decorative designs it may of course be desirable to both carve a piece of carpet and then separate the carved piece for recombining with one or more other pieces. Alternatively, the separating may take place before the carving. In either case, separating typically takes place along grooves or valleys created in the carpet during carving, where such carving is performed either before or after the separating. Typically, the carving is performed from the top or pile side of the carpet and the separating is performed from the backing side. However, this requires that the carpet be moved between the carving and separating operations. Especially where the carving and separating are performed in an automated manner, a serious issue arises in that the movement between the carving and separating operations introduces the opportunity for mis-alignment of the carpet as between the carving and separating operations. That is, unless the carpet is positioned very carefully after the first operation, the results of the second operation will not align with the results of the first operation. Accordingly, a need exists for an apparatus and method for both carving and separating, wherein mis-alignment is minimized if not eliminated.

As is known, carpet is woven or otherwise formed at a mill or the like. During such weaving/forming, the carpet by the nature of the weaving/forming process is imparted with a natural grain, whereby the carpet pile tends to 'lean' or deflect in the direction of the grain. When carving carpet in particular, the 'lay' of the grain can affect the actual position of the carving on the carpet pile. That is, as between carving across the grain, carving against the grain, carving with the grain, and carving at angles with respect to the grain, the result of the carve will appear at slightly different positions on the carpet pile as compared with the intended position. Accordingly, a need exists for a method for carving a carpet pile whereby the direction of the grain is taken into account such that the result of the carve occurs at the appropriate position on the carpet pile.

When carving and/or separating carpet, it can occur that the carving and/or separating is interrupted by a mechanical malfunction. For example, the carver and/or separator may snag on the carpet, may lose the flow of ventilation, may lose the flow of lubrication, etc. In any instance of such mechanical malfunction, it is preferable that such malfunction be detected as soon as possible in order that such malfunction does not damage and/or ruin the carpet and/or the carving and/or separating tool. Accordingly, a need exists for an apparatus and method for detecting most if not all mechanical malfunctions in a relatively simple manner.

SUMMARY OF THE INVENTION

The aforementioned need for avoiding mis-alignment as between carving and separating operations is addressed by an automated apparatus and method for forming a decorative design in carpet in accordance with one embodiment of the present invention. In the apparatus and method, the carpet is secured to a table and a carriage is controlled and moved over the table by a computer. A carver is mounted to the carriage and is controlled by the computer to carve a design into the carpet secured on the table. In addition, a separator is mounted to the carriage and is controlled by the computer to separate the carved carpet secured on the table into a plurality of pieces.

The aforementioned need for taking grain into account during carpet carving and/or separating is addressed by a method of carving a design in carpet mounted to an automated carving table in accordance with one embodiment of the present invention. The carpet has a grain extending in a first particular direction, wherein carving in a second particular direction produces an actual result offset from an intended result by a quantified offset. In the method, the first direction and second directions are determined and a relationship therebetween is calculated. An offset associated with such relationship is then determined, and the determined offset is employed to position a carver during carving of the design in the carpet in the second direction. Thus, the employed offset produces an actual result that aligns with the intended result.

The aforementioned need for mechanical malfunction detection is addressed by a method for operating an automated carpet tool in accordance with one embodiment of the present invention. The carpet tool during operation emits vibrations at a plurality of frequencies, and during normal operation emits vibrations at a particular dominant frequency. In the method, the vibrations emitted by the carpet tool are sensed, and it is determined whether the sensed vibrations are within a normal range about the particular dominant frequency of the carpet tool. If not, operation of the carpet tool is stopped, wherein it is presumed that a mechanical malfunction has taken place. In a variation, an obstructing malfunction such as a carpet snag in connection with a carver is alleviated by use of a spring hinge mount for such carver.

BRIEF DESCRIPTION OF THE DRAWINGS

The present invention will be better understood and its numerous objects and advantages will become apparent by reference to the following detailed description of the invention when taken in conjunction with the following drawings, in which:

FIG. 7 is an isolated view of the fixed blade depicted in FIG. 4;

FIG. 8 is an isolated view of the manifold depicted in FIG. 4;

FIG. 9 is a plan view of the manifold depicted in FIG. 8;

FIG. 10 is a partial side elevation view of the clipping blades and manifold assembly;

DETAILED DESCRIPTION OF THE INVENTION

Figure 1:
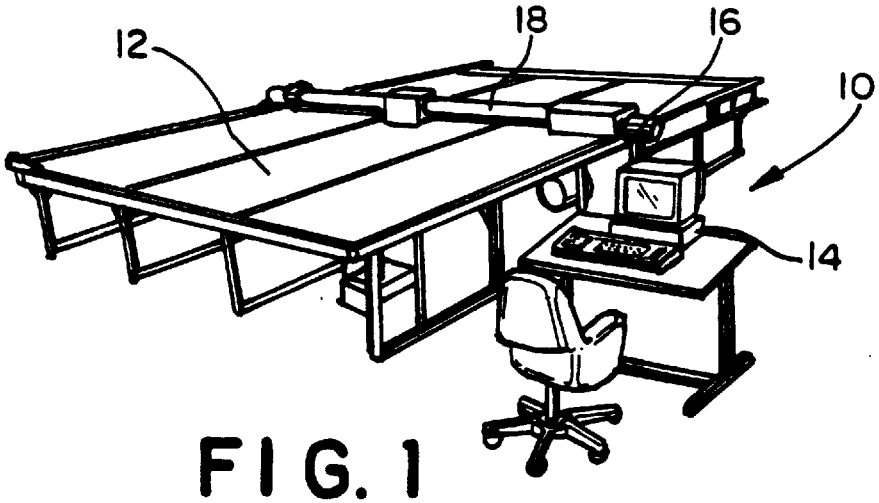
FIG. 1 is a perspective view generally depicting a carpet carving table constructed in accordance with the present invention.

A carpet pile carving device 10, constructed in accordance with the present invention, is generally depicted in FIG. 1. As shown, device 10 includes a two axis positioning table 12 which is controlled by computer 14. Table 12 includes a first motor assembly 16 for moving bridge structure 18 along the length axis. A second motor 20 (shown in FIG. 2) moves a carriage across bridge structure 18, i.e., along the width axis. In this manner, motors 16 and 18 cause table 12 to act as an x-y plotter, positioning the carriage at any desired x-y coordinate. Because such motors and the computers and software for operating same are known, they will not be discussed in any greater detail herein. It is noted that computer 14 includes a memory sufficient to store those commands necessary to cause table 12 to move the carriage in a desired pattern.

It is preferred for table 12 to include an integral vacuum feature for holding carpet to be carved securely to table 12 during any such carving operation. Again because such vacuum feature is known from the carving table product currently sold by the assignee of the present invention, it will not be described in any detail herein.

Figure 2:
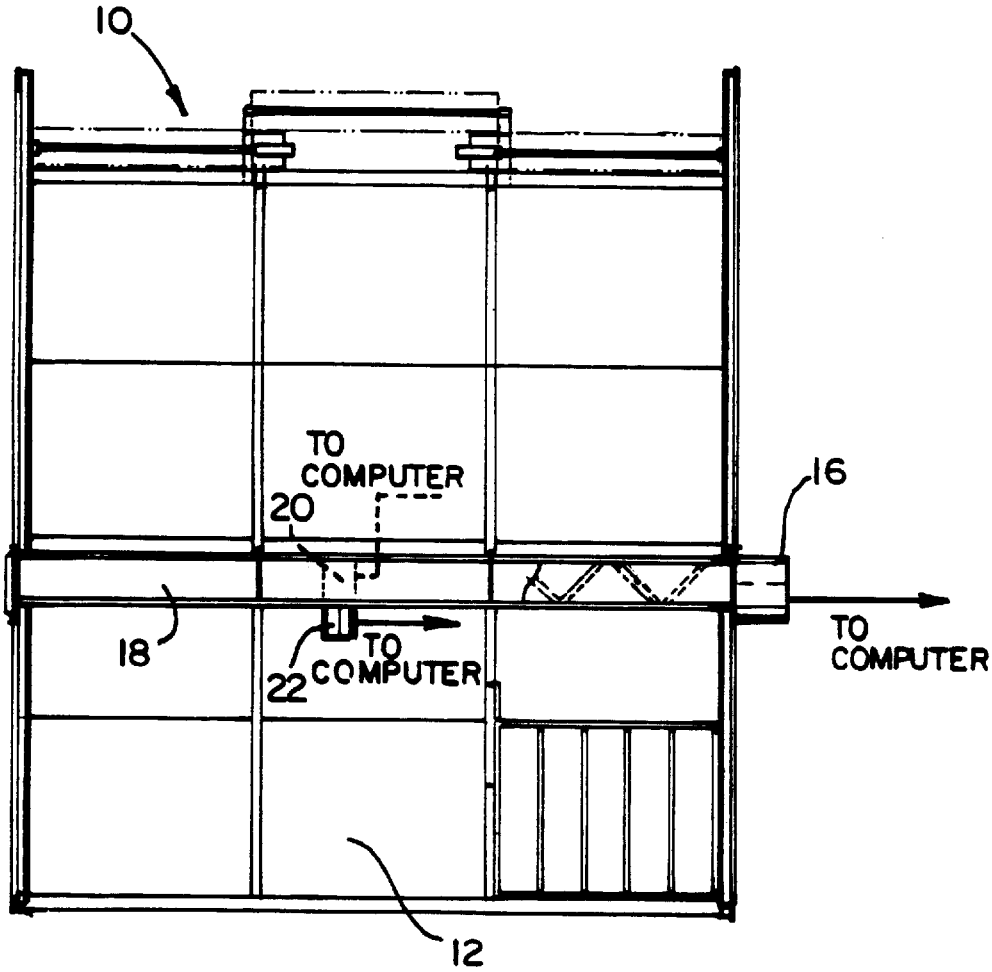
FIG. 2 is a plan view of the carving table depicted in FIG. 1.

Referring now to FIG. 2, table 12 is depicted from above. It will be appreciated that motor 20 serves to move carriage 22 across bridge 18, thereby traversing the width axis of table 12. The details of carriage 22 are depicted in FIG. 3.

Figure 3:
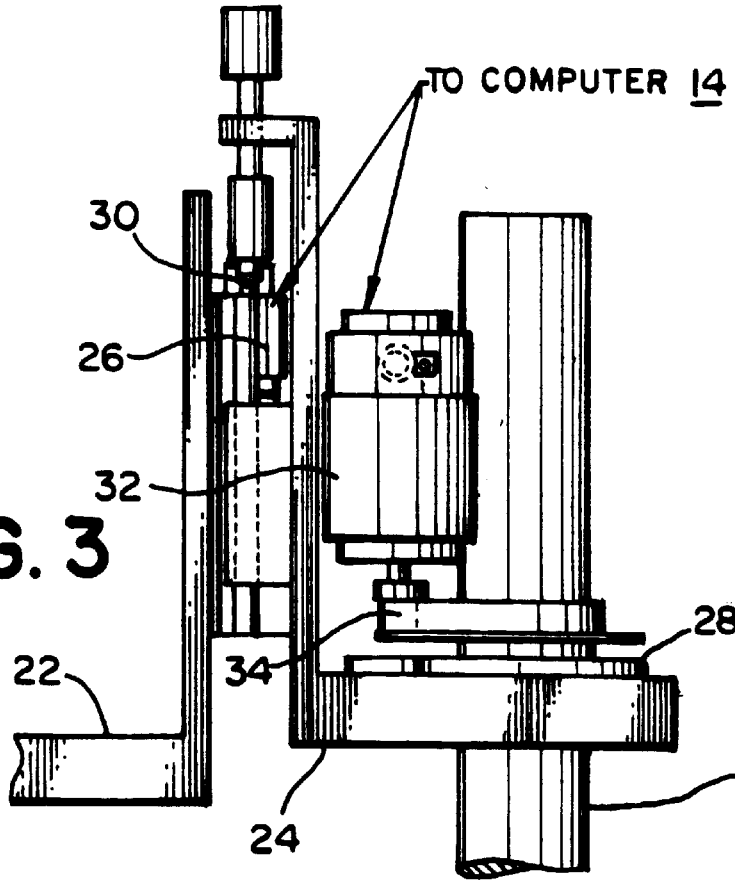
FIG. 3 is a side view of a tool platform attached to a carriage of the carving table of FIGS. 1 and 2.

As is shown in FIG. 3, tool platform 24 is attached to carriage 22 through piston 26 and rod 30. The movement of rod 30 is controlled by computer 14. As will be seen in connection with FIG. 4, movement of rod 30 causes tool platform 24 and spindle 31 to move toward or away from the carpet pile along with the clipping mechanism.

Spindle 31 is rotated by motor 32 which is mechanically coupled by assembly 34. Assembly 34 may include any appropriate gear or belt based mechanism by which the rotational movement of the shaft of motor 32 can be transmitted to the structure of spindle 31. Similar to motors 16 and 22, motor 32 is controlled by computer 14. Spindle 31 rotates in bearing 28. Again, because such the positioning motors and the computers and software for controlling same are known, as evidenced by the previous description of prior devices, that subject will not be discussed in any greater detail herein. Similarly, the details necessary for generating a control signal sufficient to cause piston assembly 26 to move rod 30 should also be known.

Figure 4:
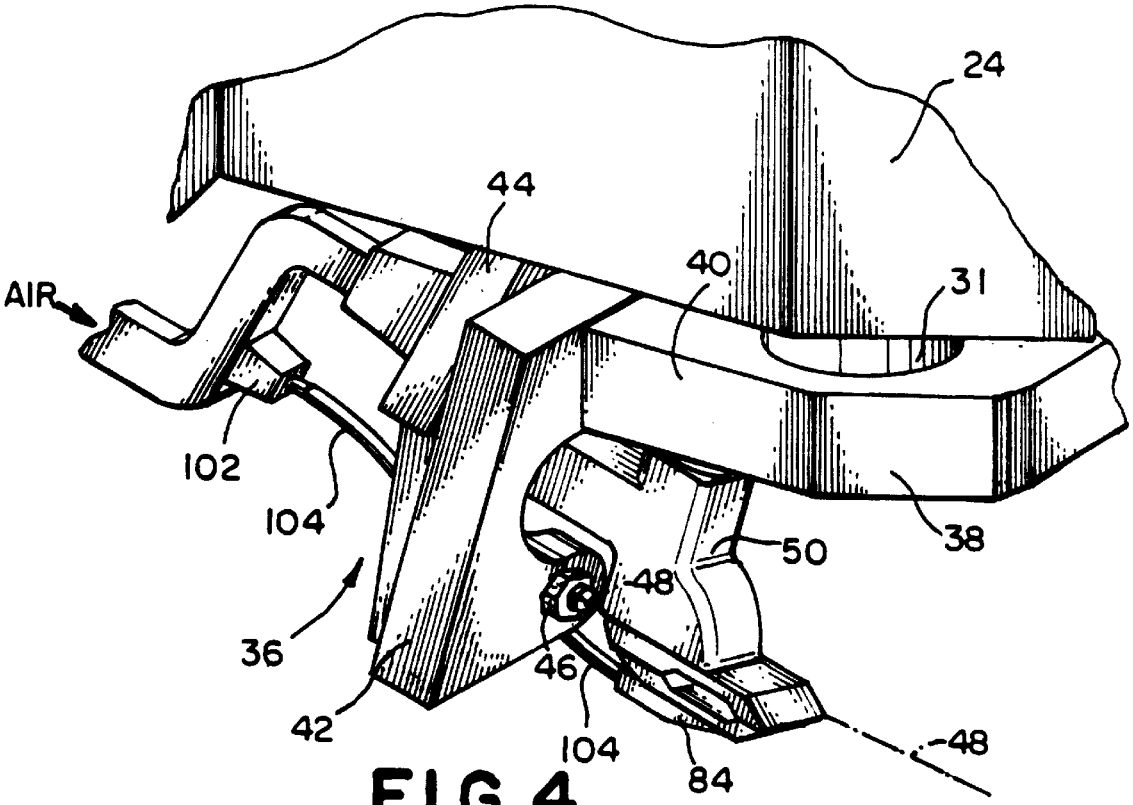
FIG. 4 is a diagrammatical perspective of a clipping head assembly constructed in accordance with the present invention.

Referring now to FIG. 4, clipping head assembly 36 will be described. Clipping head 36 is shown to be attached to rod 30. Consequently, operation of motor 32 will cause clipper head 36 to rotate. Likewise, movement of rod 30 will cause clipper head 36 to move towards and away from the carpet pile (not shown).

Clipper head 36 includes a base bracket 38, which in turn is formed from two members, namely rod connecting member 40 and a pivot connecting member 42. Bracket 44 is pivotally connected to member 42 via pivot connector 46. In the preferred embodiment, connector 46 is a nut and bolt assembly. Bracket 44 pivots about an axis 48, which axis passes through connector 46 and through the leading prong of the clipper blades. An air actuated clipping mechanism 50 is securely held by bracket 44. As will be appreciated from a description of FIGS. 5 and 6, pivotal movement of bracket 44 will result in movement of clipping mechanism 50. However, unlike prior structures, because pivot axis 48 does not pass through the body of clipper mechanism 50, but rather, passes through the leading prong of the clipping blades, the leading prong will remain relatively stationary alleviating the necessity for any software modifications in the control of motors 16, 20 and 32.

Figure 5:
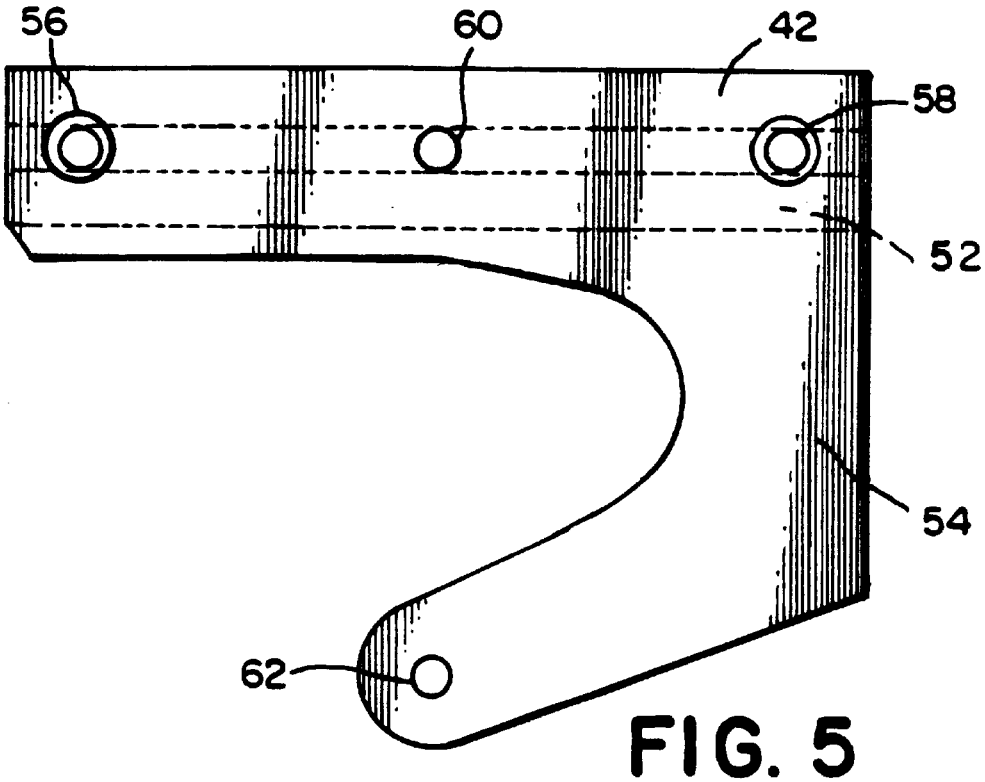
FIG. 5 is an isolated view of the base bracket depicted in FIG. 4.

Referring now to FIG. 5, member 42 will be described in greater detail. Member 42 generally includes two arms 52 and 54. Arm 52 is provided with two bores 56 and 58 for attaching member 42 to member 40. Such attachment can be by bolts, screws or any other suitable means. A further bore 60, preferably formed with threads or containing a threaded insert, thereby defining a threaded receptacle, functions to secure bracket 44 in a desired angular orientation. Arm 54 extends away from arm 52 thereby defining an area between the arms. Such area need be sufficient to permit the rotational movement clipper mechanism 50. A bore 62 is formed at the free end of arm 54. It is again noted that axis 48 passes through bore 62.

Figure 6:
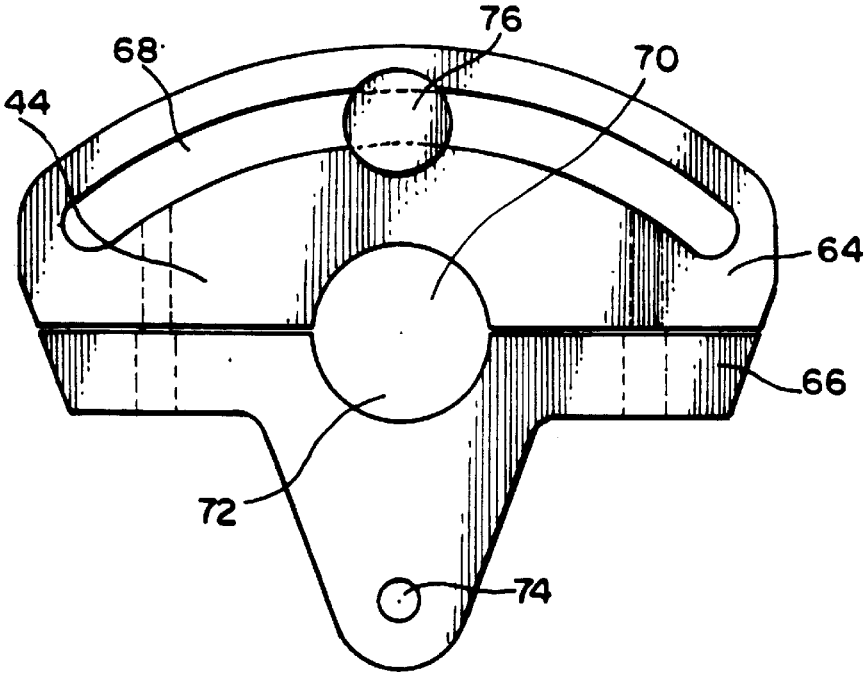
FIG. 6 is an isolated view of the pivot bracket depicted in FIG. 4.

Referring now to FIG. 6, member 44 will now be described. Member 44 includes two halves 64 and 66. Member 46 has an arcuate slot 68 formed therein and an opening 70. Member 66 also includes an opening 72. It is noted that while openings 70 and 72 are depicted as being semi-circular in shape they are not so limited. The only limitation for openings 70 and 72 is that they be appropriately shaped to firmly grip the body of clipping mechanism 50. Member 66 also has a bore 74 formed therein. This is the pivot point through which axis 48 passes and about which bracket 44, and thereby clipping mechanism 50, rotates. When member 44 is attached to member 42, via a bole or other suitable pivot pin, it is possible to pivot bracket 44, thereby pivoting mechanism 50, and maintain the relative position of the lead prong of the clipping blades. A bolt 76 is provided to hold bracket 44 in place against bracket 42. Bolt 76 passes through arcuate slot 68 and into the threaded receptacle 60.

Referring now to FIGS. 7–10, another aspect of the invention will be explained. As discussed above, one of the problems facing the automation of carpet pile carving was the undesirable temperatures the carving blades would reach after extended use. This problem has been solved in the invention by a novel cooling structure. The carving blade assembly 78 includes three basic components, a reciprocating blade 80, a fixed blade 82 and a manifold 84. The reciprocating action of blade 80 relative to blade 82 causes prongs 86, including leading prong 88, to carve carpet pile. Friction forces generated at contacting surfaces in the areas 90 and 92 cause heat to be generated. It is noted that blades 80 and 82 define an area or chamber 94 between them.

A number of bores 96 have been formed in fixed blade 82. Bores 96 are positioned to communicate with area or chamber 94, i.e., bores 96 establish fluid communication with chamber 94. Manifold 84 has a number of passages 98 formed therein. The ends of passages 98 are positioned to correspond with bores 96 when manifold 84 is mounted adjacent or on fixed blade 82. The end 100 of passages 98 is attached to a fluid supply (not shown). It is within the scope of the invention for a valve to be positioned between the fluid supply and end 100. It is also within the scope of the invention for such valve to be controlled by computer 14.

In the preferred embodiment, clipper mechanism 50 is a standard, hand operated air driven clipper. In such an embodiment a tap mechanism 102 (FIG. 4) bleeds a small amount of air from an air supply and diverts that air through appropriate hosing 104 and into end 100 in manifold 84. Air then passes through passages 98, through bores 96 and into area or chamber 94. Since the ends of chamber 94 are open, as shown in FIG. 10, the air passes out and away from the clipping blades. It has been found that such movement of air, between the clipping blades, removes excess heat generated as a result of the previously described friction forces.

Another aspect of the invention deals with the problem of tufts created due to deflection or compression of pile when the carving blades are moved against the pile. It will be recalled from the above that the carriage is moved to desired locations in response to a control signal generated by computer 14. In addition, clipper head 50 is moved by the carriage onto the carpet pile so that the clipper head can be moved in a desired direction. Computer 14 in such instances is programmed to generate the control signals necessary for slightly moving the carriage, so that the control signals initially cause the clipper head to be moved a distance away from the point where the lead prongs are against the pile in a direction other than the intended direction of movement. As used herein the term slight is relative to the depth of the pile. The amount of movement needs to be sufficient to allow the pile to return to its natural shape, i.e., extending out. It is envisioned that such movement will total between ⅙to ½inch. It is especially preferred for the clipper head to move a distance away in a direction substantially 180 degrees from the desired direction of movement.

Figure 11:
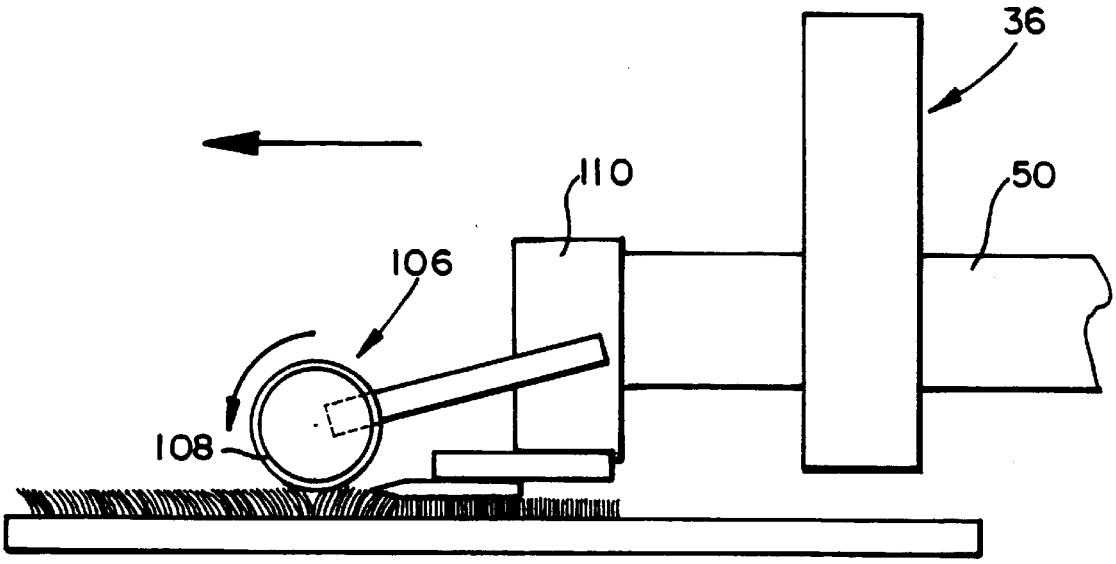
FIG. 11 is a diagrammatic view of a clipping head assembly constructed in accordance with the present invention, including a pile orientation mechanism.
Figure 12:
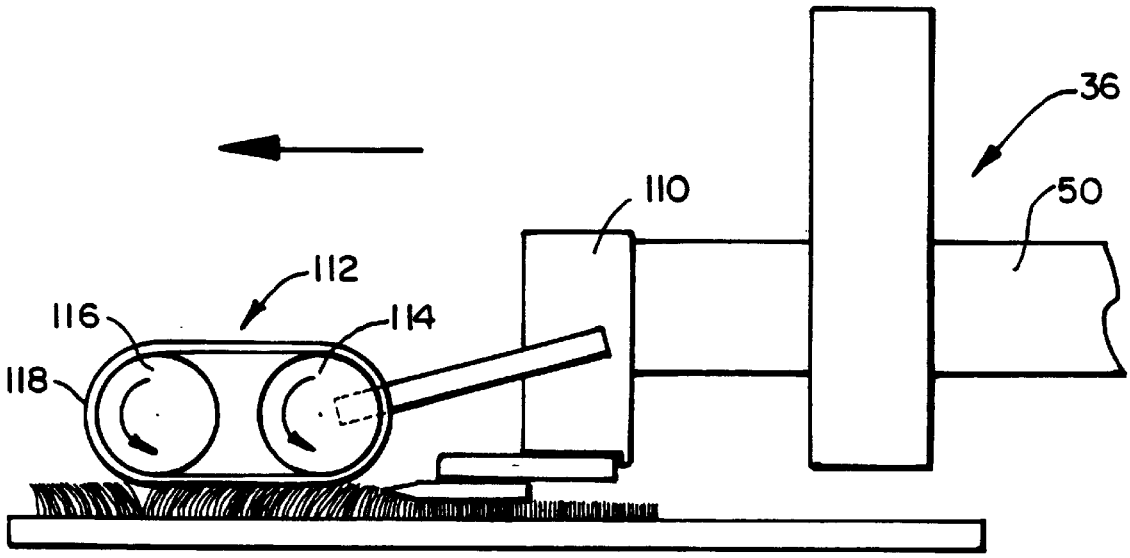
FIG. 12 is a diagrammatic view of a clipping head assembly constructed in accordance with the present invention, including an alternative embodiment of the pile orientation mechanism depicted in FIG. 11.

A still further aspect of the invention addresses the problem identified above regarding random pile angle. Referring now to FIG. 11, an alternative embodiment of the invention is shown. A pile orientation member 106 is depicted for orienting pile in the path of the clipper head so that the pile is oriented in a plane substantially perpendicular to the carving plane, i.e., the plane in which the carving blades are carving. As shown a friction engaging member, in this case a roller 108 frictionally engages the pile and orients it for the carving blades. It is noted that roller 108 is driven by driver 110 to turn in a direction which pushes the pile towards the carving blades. As shown in FIG. 12, the friction engaging member is belt assembly 112, wherein the assembly includes a pair of rollers 114, 116 about which extends a belt 118. Although two specific embodiments are shown, friction engaging member 106 can take any number of forms, for example, a drum, a brush, a elastic wheel or even a jet or flow of fluid.

As was discussed above, one way of forming a decorative design in carpet is to both carve and separate and re-combine pieces of carpet, where the separating takes place along grooves or valleys created in the carpet during carving. However, when the carving and separating are automated, care must be taken to ensure that the results of such operations are aligned. Chiefly, mis-alignment occurs when the carpet is moved between the carving and separating processes. In particular, and as should be understood, any carpet movement alters the three physical dimensions thereof. Such movement can be described as stretch, bow, skew, distortion, elongation, etc. Over larger sizes of carpets, the total movement can be significant, with the result being that mis-alignments become more noticeable.

Figure 13:
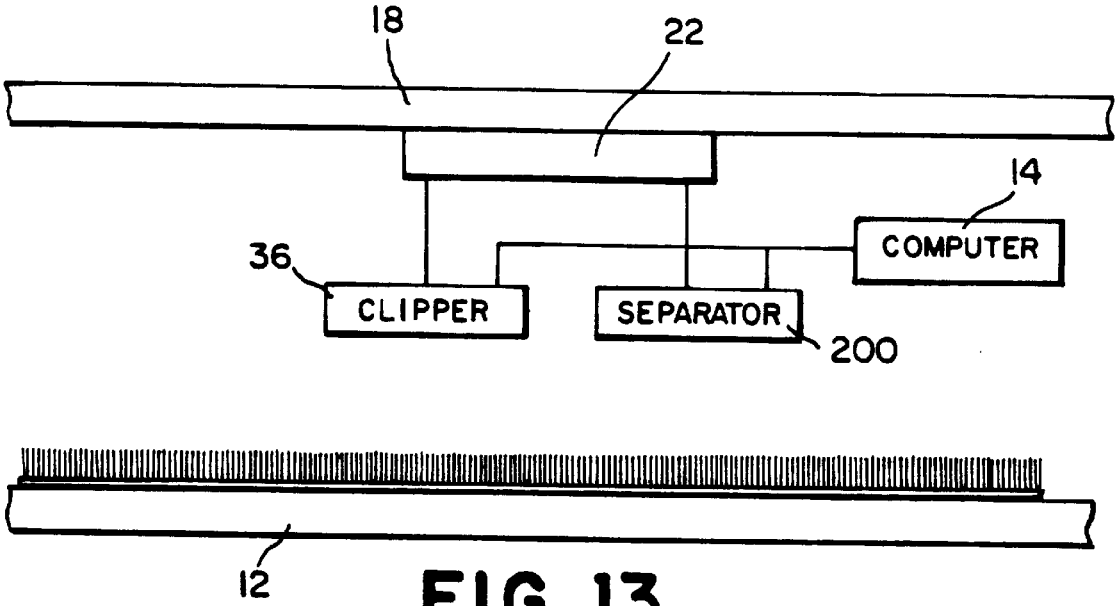
FIG. 13 is a diagrammatic view showing a clipper and separator mounted to a carriage in accordance with one embodiment of the present invention.

In one embodiment of the present invention mis-alignment is minimized if not eliminated by mounting the carpet on the table 12, carving the carpet with the clipper 36 as mounted to the carriage 22, and then separating the carved carpet with a separator 200 which is also mounted to the carriage 22, as is shown in FIG. 13. Importantly, the carpet is separated by the separator 200 at the pile side, and not at the backing side. Accordingly, the carpet need not be moved from the table 12 or re-positioned on the table 12 between the carving and separating operations, and the possibility of mis-alignment resulting from such a move is eliminated. Also, and importantly, fabrication time is significantly shortened.

The separator 200 may be any appropriate separator without departing from the spirit and scope of the present invention. For example, the separator 200 may be a low speed blade, an ultrasonic blade, an ultra high speed water knife, a laser knife, or the like. Such separators are known and therefore need not be discussed herein in any detail. The separator 200 may be mounted to the carriage 22 in a manner similar to that employed for the clipper 36, i.e. the piston assembly 26, bearing assembly 28, and rod 30 of FIG. 3, where the movement of rod 30 toward or away from the carpet pile is controlled by computer 14. Thus, the separator 200 and the clipper 36 generally reside side-by-side on the carriage 22, at a particular offset as compared to the clipper 36 (with reference to the x-y plane of the table 12. Moreover, the separator 200 is controlled and moved by the computer 14 in a manner substantially similar to the manner in which the computer 14 controls and moves the clipper 36.

Figure 14:
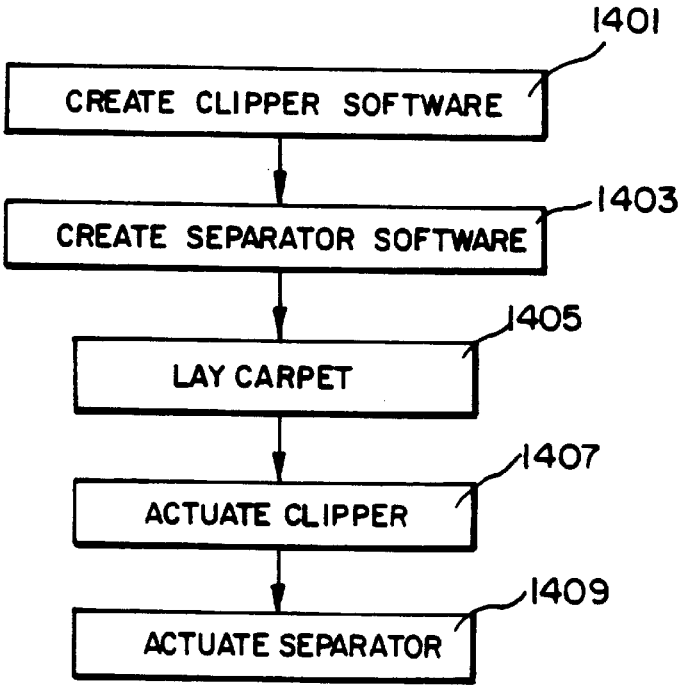
FIG. 14 is a flow chart showing steps performed in connection with the clipper and separator of FIG. 13.

In operation, and referring now to FIG. 14, a software file is created for operating the clipper 36 (step 1401), and a software file is also created for operating the separator 200 (step 1403). The aforementioned software files may in fact be a single software file, but the file(s) are created based in part on the premises that (1) the carpet is to be carved and then separated, (2) the carpet will not be moved between the carving and separating, and (3) the carpet will be carved and separated at the pile side.

As is known, such software defines paths the clipper 36 and separator 200 respectively follow in the x-y plane during respective carving and separating operations. In addition, the software defines when the clipper and separator respectively are moved up or down (i.e., along the z-axis). While creating such software file(s) is known, it is noteworthy in the context of the present invention that when operating the clipper 36, a first x-y offset must be employed by the software to calculate proper positioning for the clipper36, and a second x-y offset must be employed by the software to calculate proper positioning for the separator 200.

Once the software has been created and loaded on the computer 14, a piece of carpet must be laid upon the table 12 (step 1405) in an appropriate position. Preferably, the carpet piece is immobilized, either by a vacuum system as was described above, by being taped down, or by another hold-down device or mechanism.

Thereafter, the computer 14 actuates the clipper 36 (step 1407) to perform a series of carving operations based on the software for such clipper 36. Typically, the clipper 36 is moved along a series of paths to carve a design into the carpet such as for example an image of a flower. If the clipper 36 is inclined at an angle such as with the bracket 44 of FIGS. 5 and 6, and if the clipper 36 is made to traverse a path in both directions, the clipper 36 will define a V-shaped groove in the pile of the carpet laid upon the table 12.

A picture defined by such V-shaped grooves may then be separated along such V-shaped grooves. Specifically, once the carving operation is completed, the computer 14 actuates the separator 200 (step 1409) to perform a series of separating operations based on the software for such separator 200. As with the clipper 36, the separator 200 is typically moved along a series of paths, perhaps along the V-shaped grooves defined by the carving operation. Of course, the separating operation may be performed along other paths without departing from the spirit and scope of the present invention. Once the separating operation is complete, the carpet may then be separated and re-combined with other pieces of carpet which have been or which will be carved and separated. Typically, such re-combing is achieved by pasting the pieces of carpet together by way of an appropriate backing, although other methods of recombination may be employed without departing from the spirit and scope of the present invention.

As was discussed above, carpet is imparted with a natural grain, whereby the carpet pile tends to 'lean' or deflect in the direction of the grain. When carving carpet in particular, the 'lay' of the grain can affect the actual position of the carving on the carpet pile, especially if the clipper 36 is inclined at an angle such as with the bracket 44 of FIGS. 5 and 6. For example, if carving across the grain in one direction, the result of the carve may actually be a small but appreciable distance off from that which was intended (perhaps a millimeter or two, or even more), quantifiable as a first offset. Similarly, if carving across the grain in the opposite direction, the result of the carve may likewise be a small but appreciable distance off from that which was intended, quantifiable as a second offset different from the first offset. Similar quantifiable offsets may be noted for carving against the grain, carving with the grain, and carving at angles with respect to the grain. It is to be noted that the aforementioned offsets may be offsets in the x-y plane corresponding to the plane of the table 12, as well as offsets in the x-y-z space above the table 12. While not all carpets with grain exhibit such offset characteristics, it is to be noted that such offset characteristics are more likely to become evident with deeper pile, smaller tuft diameter, and stronger grain, for example.

Figure 15:
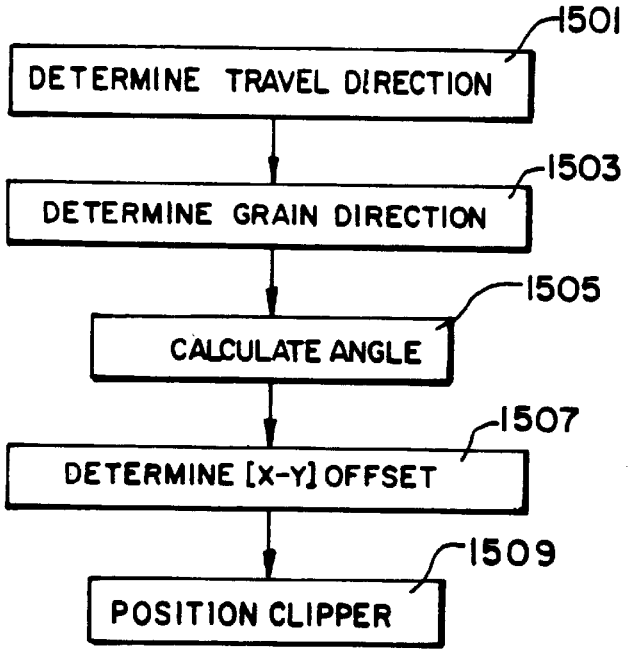
FIGS. 15 and 16 are flow charts showing steps performed in carving carpet based on offsets that take grain into account (FIG. 15), and in developing the offsets (FIG. 16) in accordance with one embodiment of the present invention.

In one embodiment of the present invention, the aforementioned offsets are taken into account when positioning the clipper 36. Specifically, and referring now to FIG. 15, based on the direction of travel of the clipper 36 (step 1501), and based on the direction of the grain (step 1503), an angle or the like with respect to the grain is calculated (step 1505), an offset associated with such angle is found (step 1507), and such offset is employed to position the clipper 36 during travel in the aforementioned direction (step 1509). As should be appreciated, then, the result of the carve aligns more closely with that which was intended.

While the direction of grain likely need only be determined (step 1503) once, it is expected that at least some of such steps 1501–1509 are performed each time the direction of travel of the clipper 36 changes. Presumably, the steps 1501 and 1505–1509 are performed by the computer 14. The determination of the direction of the grain (step 1503) may be performed in an automated basis or may be performed manually, and is then input into the computer 14. Such steps 1501 and 1505–1509 may be performed before the clipper 36 begins to carve the carpet pile, or may be performed during such carving (i.e., 'on the fly') without departing from the spirit and scope of the present invention. It is expected that changes in offsets that occur as a result of 'smooth' changes in the direction of travel will not result in discernible discontinuities in the carve, although angle turns, and particularly sharp angle turns, may have to be considered as cases requiring special consideration.

Figure 16:
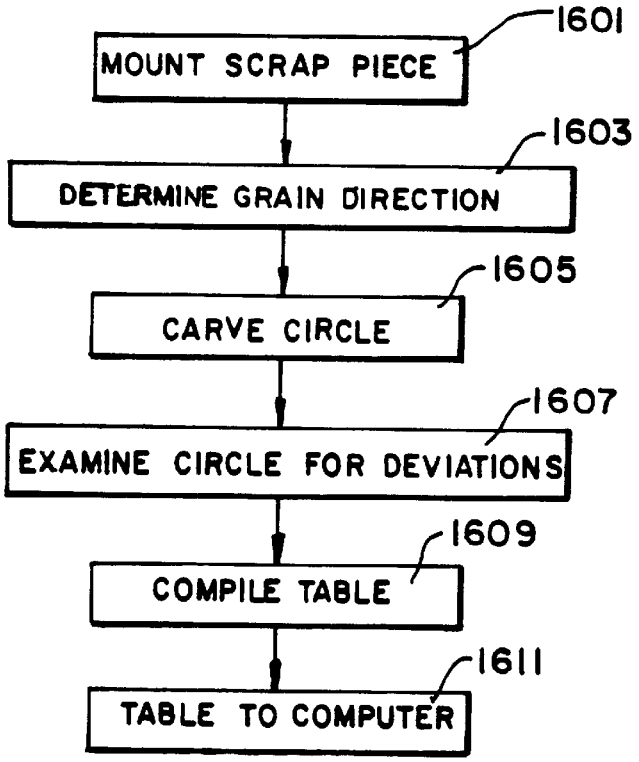

Of course, to perform the method of steps 1501–1509, it is first necessary to compile offset data. In one embodiment of the present invention, and as 30 shown in FIG. 16, such offset data is compiled by mounting a scrap piece of carpet to the table 12 (step 1601), determining the direction of the grain on the scrap piece (step 1603), and employing the computer 14 and clipper 36 to carve a design such as a circle on the scrap piece (step 1605) without taking into consideration any offset in the manner of steps 1501 and 1505–1509.

Such carved circle is then examined for deviations from true (step 1607). Such examination may be performed in an automated manner, or may be performed manually. In one embodiment of the present invention, during examination of the carved circle, x, y, and/or z deviations from true or the like are noted in a plurality of angular locations on the carved circle, and are then compiled into a table or the like (step 1609) containing the offsets, the angular locations, and/or the clipper directions at such angular locations (each clipper direction presumably being tangential to the carved circle at the respective angular location). Such table is then provided to the computer 14 (1611).

The actual number of angular locations or the like and data therefor in the table can vary without departing from the spirit and scope of the present invention. For example, such number may be 8, 10, 12, 20, etc. In one embodiment of the present invention, the computer 14 employs an interpolation routine during performance of step 1507 if a precise offset is not available from the table for the direction of travel at issue.

Moreover, with such interpolation routine, as little as two data entries are necessary in the table: the angle and offset when going across the grain in one direction, and when going across the grain in the other direction. In particular, if it is assumed that there is zero offset when going with or against the grain, and that the angles for going with and against are half-way between going across in both directions, the aforementioned two data entries in fact imply two more, and the resulting four entries may be used in such interpolation routine. Of course, using additional data entries will provide better accuracy in the result of the interpolation routine. Nevertheless, good results have been obtained empirically by using only the two aforementioned data entries.

When carving a production piece of carpet based on the compiled offset data, such production piece should of course be similar to the aforementioned scrap piece, if not carved from the same roll, and should be oriented in the same manner as the scrap piece so that the grains of both pieces are in the same direction. Alternatively, if the grain directions differ, either by choice or by necessity, such difference is noted and offset calculations by the computer 14 take such difference into account.

It is to be noted that the aforementioned offsets have heretofore been quantified in terms of spatial characteristics (x, y, and/or z) or the like. As should be appreciated, however, such offsets can also include other characteristics. As but one example, appropriate offset information may include a speed or adjustment in speed with which the clipper 36 travels. Such speed information may be determined empirically or by any appropriate calculation.

It is to be appreciated that the actual calculations performed by the computer 14 in performing the aforementioned steps are based on known principles of mathematics. Accordingly, such calculations are not set forth herein in any detail. Nevertheless, any-particular methods for performing such calculations may be employed without departing from the spirit and scope of the present invention.

As was noted above, carpet carving and/or separating can be interrupted by mechanical malfunctions such as for example a carpet snag or a loss of lubricant supply, among other things. Such malfunction can damage or destroy both the tool and the carpet.

As is conspicuous, carpet carving and separating tools such as the clipper 36 and the separator 200 and the like tend to produce rather pronounced mechanical vibrations during operation, as evidenced by relatively loud noises. Notably, the aforementioned mechanical malfunctions tend to change the frequency of such vibrations, perhaps in a manner immediately recognizable even to the human ear. In one embodiment of the present invention, then, such malfunctions are sensed by noting changes in the vibrations produced by a carpet tool, and reacting accordingly, such as for example by automatically shutting down the tool.

Figure 17:
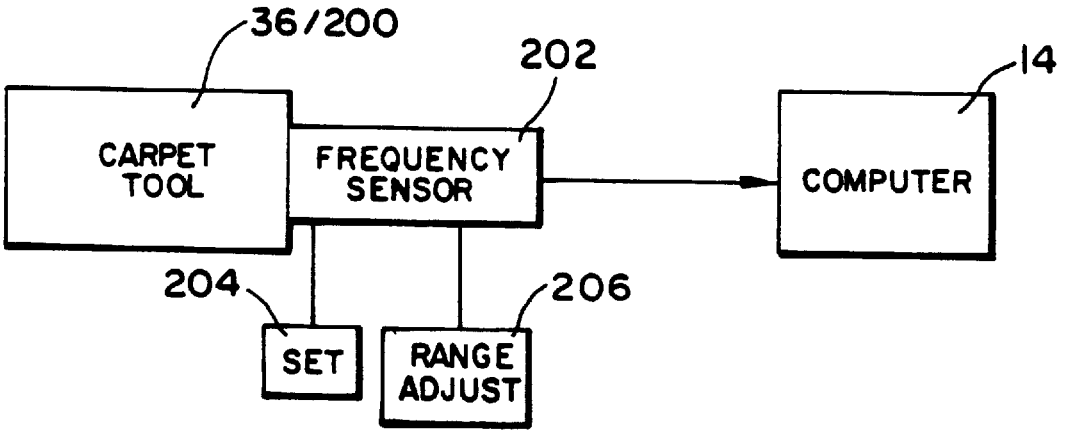
FIG. 17 is a block diagram showing a frequency sensor employed in connection with one embodiment of the present invention.
Figure 18:
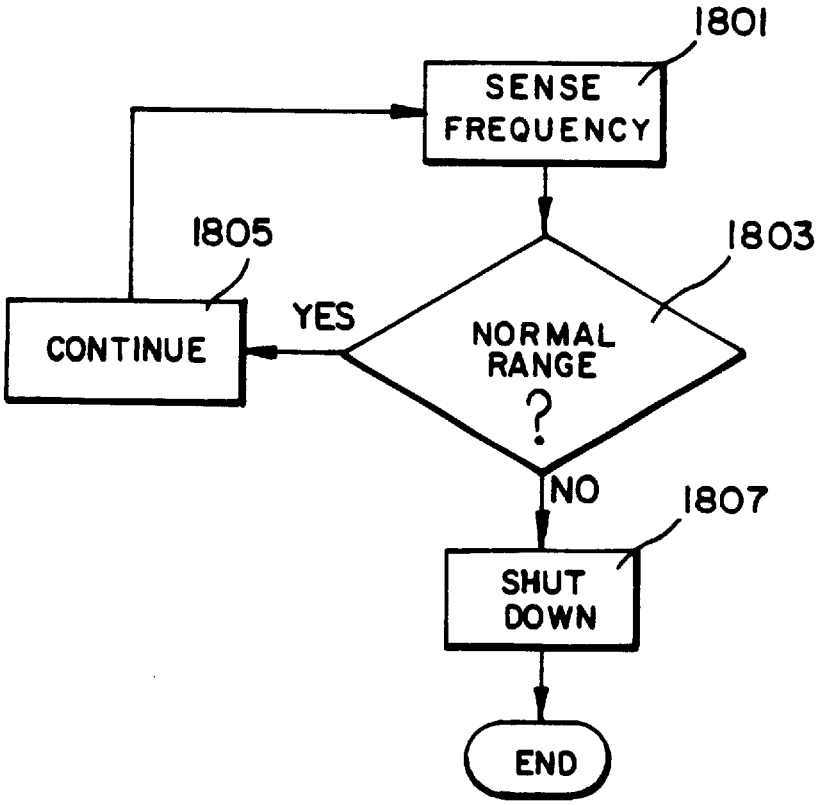
FIG. 18 is a flow chart showing steps performed in connection with the frequency sensor of FIG. 17.

In particular, in the present invention, a frequency sensor 202 is coupled to a carpet tool 36/200, as is shown in FIG. 17, and senses the frequency of the vibrations produced by such carpet tool 36/200. The frequency sensor 202 is also coupled to the computer 14, and reports sensed frequencies thereto. If, as shown in FIG. 18, the computer 14 determines that the sensed frequency (step 1801) is within a normal range (step 1803), the operation continues (step 1805). If the computer 14 determines that the sensed frequency has changed from pre-determined normal parameters and is thus outside of a normal range (step 1803), the computer 14 assumes a mechanical malfunction has taken place and therefore shuts down the carpet tool 36/200 (step 1807) in an effort to minimize or prevent damage to the tool 36/200 and to the carpet on the table 12. As shown, the computer 14 performs the aforementioned steps 1801–1805 repeatedly. Alternatively, the sensor 202 itself may determine that the sensed frequency has changed from the pre-determined normal parameters and report such condition to the computer 14. While the sensor 202 may be employed in connection with the clipper 36 and/or the separator 200, such sensor 202 may also be employed with any other carpet tool without departing from the spirit and scope of the present invention.

The frequency sensor 202 may be any appropriate frequency sensor without departing from the spirit and scope of the present invention. For example, the sensor 202 may be a vibration sensor coupled directly to the carpet tool 36/200, or a sound sensor physically spaced from the carpet tool 36/200 but attuned to such carpet tool 36/200. Moreover, the sensor 202 may incorporate a reed-type device, a diaphragm-type device, a microphone or the like, a piezoelectric device, etc. The frequency sensor 202 may even be a tachometer or the like.

It is expected that the frequency of vibration produced by a carpet tool 36/200 during normal operation will vary from tool 36/200 to tool 36/200, and will even vary in a single tool 36/200. For example, a clipper 36 might produce a normal dominant frequency of vibration of about 200 hertz, while a separator 200 might produce a normal dominant frequency of 10,000 hertz at a 'low' speed and of 15,000 hertz at a 'high' speed. Thus, the sensor 202 may include a 'set' button 204 or the like that is actuated during normal operation of the carpet tool 36/200 by a shop worker or the like to denote what the sensor 202 should be sensing during such normal operation.

It is also expected that the range of the dominant frequency associated with normal operation will vary from tool 36/200 to tool 36/200. Thus, the sensor 202 may include a range adjust 206 or the like that is adjusted by the shop worker to denote an acceptable range about the set frequency. In the case of a clipper 36 with a normal dominant frequency of vibration of about 200 hertz, for example, the acceptable range may be set at +/−50 hertz. Thus, if the clipper 36 ejects its blade and thus increases its dominant frequency above 250 hertz, the computer 14 will shut such clipper 36 down. Likewise, if the blade of the clipper 36 snags on the carpet and thus decreases its dominant frequency below 150 hertz, the computer 14 will likewise shut such clipper 36 down.

Figure 19:
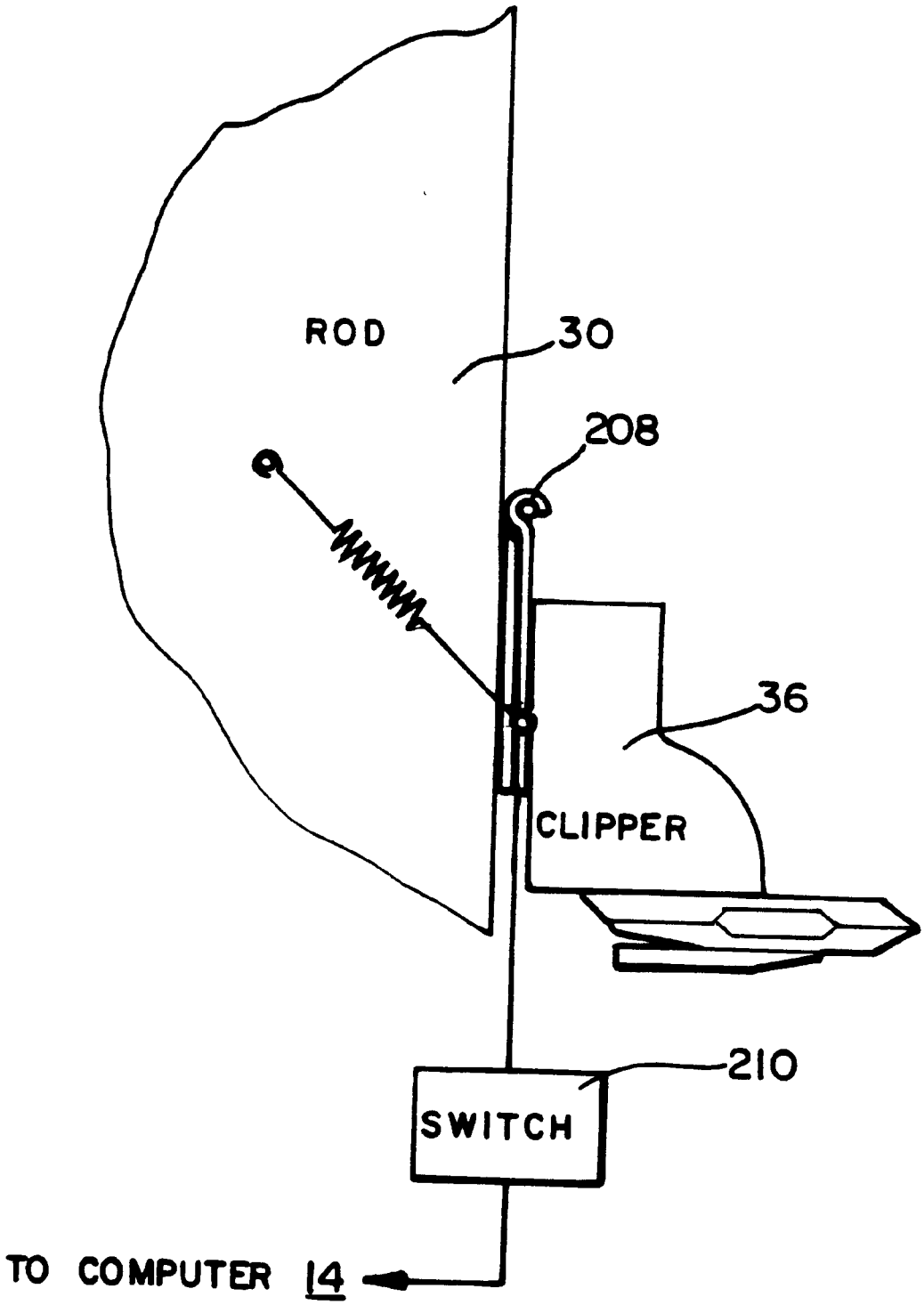
FIG. 19 is a diagrammatic view showing a clipper mounted to a carriage by way of a spring hinge mount in accordance with one embodiment of the present invention.

In a variation of the present invention, and referring now to FIG. 19, an obstructing malfunction such as a carpet snag is alleviated by use of a spring hinge mount for the carpet clipper 36. In such spring hinge mount, the clipper 36 is mounted to a spring hinge 208 which is in turn mounted to the spindle 31 (FIG. 4) on the carriage, and the spring hinge 208 is designed to release under a sufficient force such as that which may be experienced when the clipper 36 snags on the carpet. Thus, the releasing hinge 208 allows the clipper 36 to swing away from the carpet and the snag, thereby avoiding or minimizing damage to the clipper 36 and the carpet. Preferably, the spring hinge mount includes a switch 210 or the like to signal to the computer 14 when the hinge 208 has been released. Thus, such computer 14 can appropriately respond to the obstructing malfunction by notifying an attendant, shutting the clipper 36 down, annunciating an alarm, and/or the like.

In the present invention, mis-alignment as between carving and separating operations is minimized if not eliminated by carving first and then separating without any intervening carpet movement; the direction of carpet grain is taken into account during carving by including offsets based on the direction of carving; and most mechanical malfunctions are sensed in a relatively simple manner by a frequency sensor. While the invention has been described and illustrated with reference to specific embodiments, those skilled in the art will recognize that modification and variations may be made without departing from the principles of the invention as described herein above and set forth in the following claims.

What is claimed is:

1. A method for automatedly forming a decorative design in carpet, the method comprising:

securing the carpet to a table having a carriage mounted thereover, the carriage controlled and moved over the table by a computer;

carving a design into the carpet secured on the table with a carver mounted to the carriage and controlled by the computer; and separating the carved carpet secured on the table into a plurality of pieces with a separator mounted to the carriage and controlled by the computer.

2. The method of claim 1 wherein the carpet has a pile side and a backing side, and wherein the method comprises separating the carpet at the pile side thereof.

3. The method of claim 1 wherein the separator and the carver reside side-by-side on the carriage, the method comprising carving with the carver based on a first x-y offset with respect to the table and separating with the separator based on a second x-y offset with respect to the table different from the first x-y offset.

4. The method of claim 1 wherein the carving step comprises moving the carver under the control of the computer to define a groove in the carpet secured on the table, and wherein the separating step comprises moving the separator under the control of the computer to separate the carpet along the groove.

* * * * *